US006460548B1

(12) United States Patent
Gordon et al.

(10) Patent No.: US 6,460,548 B1
(45) Date of Patent: Oct. 8, 2002

(54) LIQUID HARD-SURFACE CLEANING COMPOSITIONS BASED ON SPECIFIC DICAPPED POLYALKYLENE GLYCOLS

(75) Inventors: Neil James Gordon, Strombeek-Bever (BE); Marc Francois Theophile Evers, Strombeek-Bever (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/367,560

(22) PCT Filed: Feb. 10, 1998

(86) PCT No.: PCT/US98/02628

§ 371 (c)(1),
(2), (4) Date: Aug. 16, 1999

(87) PCT Pub. No.: WO98/36042

PCT Pub. Date: Aug. 20, 1998

(30) Foreign Application Priority Data

Feb. 14, 1997 (EP) ..... 97870017

(51) Int. Cl.[7] ..... C11D 1/72; C11D 3/75; C11D 3/37

(52) U.S. Cl. ..... 134/25.2; 134/42; 510/413; 510/421; 510/475; 510/476; 510/506; 510/528; 510/535

(58) Field of Search ..... 510/413, 421, 510/475, 476, 506, 528, 535; 134/25.2, 42

(56) References Cited

U.S. PATENT DOCUMENTS

| | | | | | |
|---|---|---|---|---|---|
| 4,368,146 | A | * | 1/1983 | Aronson et al. | 252/542 |
| 4,548,729 | A | * | 10/1985 | Schmid et al. | 252/174.21 |
| 4,780,237 | A | * | 10/1988 | Schmid et al. | 252/174.22 |
| 5,433,840 | A | * | 7/1995 | Dahms et al. | 205/296 |

FOREIGN PATENT DOCUMENTS

| | | | | |
|---|---|---|---|---|
| EP | 343503 | * | 11/1989 | C11D/1/72 |
| EP | 0343503 | * | 11/1989 | |

* cited by examiner

*Primary Examiner*—Yogendra N. Gupta
*Assistant Examiner*—Brian P. Mruk
(74) *Attorney, Agent, or Firm*—Kevin L. Waugh; Jason J. Camp

(57) ABSTRACT

Liquid hard-surface cleaning compositions are disclosed which comprise particular dicapped polyalkoxylene glycols. These compositions provide excellent next-time cleaning performance on hard-surfaces soiled by various soils, especially greasy type soils and/or burnt/sticky food residues typically found in a kitchen.

15 Claims, No Drawings

LIQUID HARD-SURFACE CLEANING COMPOSITIONS BASED ON SPECIFIC DICAPPED POLYALKYLENE GLYCOLS

TECHNICAL FIELD

The present invention relates to liquid compositions for cleaning hard-surfaces.

BACKGROUND

Liquid compositions for cleaning hard-surfaces have been disclosed in the art. Much of the focus for such compositions has been on providing outstanding cleaning on a variety of soils and surfaces. However, such compositions are not fully satisfactory from a consumer viewpoint especially regarding the soil release properties imparted to the hard-surfaces treated therewith. Indeed, consumers are looking for liquid cleaning compositions that would render a hard surface first treated therewith less prone to soil adherence and thus facilitate next-time (subsequent) cleaning operation.

Thus, the object of the present invention is to formulate a liquid cleaning composition for removal of various soils from hard-surfaces that will facilitate the next-time cleaning operation.

It has now been found that the next-time cleaning performance is improved when a hard-surface has first been treated with a liquid composition comprising a particular antiresoiling ingredient, namely a dicapped polyalkoxylene glycol of the formula $R_1$—O—$(CH_2$—$CHR_2O)_n$—$R_3$, wherein the substituents $R_1$ and $R_3$ each independently are substituted or unsubstituted, saturated or unsaturated, linear or branched hydrocarbon chains having from 1 to 30 carbon atoms, or amino bearing linear or branched, substituted or unsubstituted hydrocarbon chains having from 1 to 30 carbon atoms, $R_2$ is hydrogen or a linear or branched hydrocarbon chain having from 1 to 30 carbon atoms, and wherein n is an integer greater than 0. Indeed, it has surprisingly been found that the use of such a dicapped polyalkoxylene glycol, in a liquid composition, provides improved next-time cleaning performance on a hard-surface first treated therewith at low total level of antiresoiling ingredients. Thus, in its broadest aspect, the present invention encompasses the use of a dicapped polyalkoxylene glycol as defined herein, in a liquid composition, to inhibit adherence of soils on a hard-surface after the surface has been first treated with the composition, thereby facilitating the removal of the soils from the surface on next-time cleaning. The present invention also encompasses liquid cleaning compositions with particular dicapped polyalkoxylene glycols as defined herein after.

An advantage of the present invention is that the next-time cleaning performance is obtained according to the present invention on various types of stains/soils including typical greasy stains like kitchen grease, and burnt/sticky food residues like burnt milk stains, typically found in a kitchen. Furthermore, another advantage of the present invention is that the next-time cleaning benefit is obtained by using a biodegradable and cost efficient antiresoiling ingredient.

Another advantage of the liquid compositions of the present invention is that not only next-time cleaning performance is improved but that also good first time cleaning performance is delivered, as well as good surface appearance after cleaning.

Yet another advantage is that the liquid compositions according to the present invention may be used to clean hard-surfaces made of a variety of materials like glazed and non-glazed ceramic tiles, vinyl, no-wax vinyl, linoleum, melamine, glass, plastics, plastified wood, metallic surfaces, both in neat and diluted conditions, e.g., up to a dilution level of 1 200 (composition:water).

The following patent applications are representative of the prior art:

EP-A-374 471 discloses liquid hard-surface cleaning compositions which are formulated to leave on the surface treated a protective barrier layer which serves to protect the surface against further soil deposition. These compositions comprise a polyethylene glycol alkylphenyl ether, lecithin and an aminofunctional polydimethylsiloxane copolymer as a protective barrier compound and one or more glycols. No dicapped polyalkoxylene glycols as defined in the present invention are disclosed.

EP-A-635 567 discloses liquid compositions for cleaning solid surfaces comprising a cleaning agent capable of being deposited on the surface during cleaning and of forming a dried layer adhered to the surface, said layer having a cohesive strength such that at least outermost surface portion of the layer is removable by further washing. Polyvinylpyrrolidone is disclosed. No dicapped polyalkoxylene glycols as defined in the present invention are disclosed.

EP-A-379 256 discloses acidic hard surface compositions (pH 2–4) comprising different cleaning ingredients amongst which polybeta methyl diethyl ammonium ethyl methacrylate methyl sulfate (MDAEM). Secondary cleaning benefit is expressly mentioned. No dicapped polyalkoxylene glycols as defined in the present invention are disclosed.

EP-A-326 795 discloses the use of polyethylenglycolether of the formula $R_1$—O—$(CH_2$—$CH_{2-O)n}$—$R_2$, wherein $R_1$ is linear or branched alkyl- or alkenyl group of 20 to 28 carbon atoms, $R_2$ is an alkyl group of 4 to 8 carbon atoms and n is from 6 to 20, as a foam reducing agent, in a detergent formula.

European patent application number 96870070.8 discloses a cleaning composition comprising a hypochlorite bleaching component, a hypochlorite compatible surfactant and a nonionic surfactant having the formula R1(OR2)$_n$OR3, wherein $R_1$ is a C8–C18 linear or branched alkyl or alkenyl group, aryl group, alkaryl group, R2is a C2–C10 linear or branched alkyl group, R3 is a C1–C10 alkyl or alkenyl group and n is an integer ranging in the range of from 1 to 20.

Actually, the next-time cleaning performance benefit associated to a dicapped polyalkoxylene glycol as defined herein has not been acknowledged in the prior art.

SUMMARY OF THE INVENTION

The present invention encompasses the use of a dicapped polyalkoxylene glycol of the formula $R_1$—O—$(CH_2$—$CHR_2O)_n$—$R_3$, wherein the substituents $R_1$ and $R_3$ each independently are substituted or unsubstituted, saturated or unsaturated, linear or branched hydrocarbon chains having from 1 to 30 carbon atoms, or amino bearing linear or branched, substituted or unsubstituted hydrocarbon chains having from 1 to 30 carbon atoms, $R_2$ is hydrogen or a linear or branched hydrocarbon chain having from 1 to 30 carbon atoms, and wherein n is an integer greater than 0, in a liquid composition, to inhibit adherence of soils on a hard-surface after said surface has been first treated with said composition, thereby facilitating the removal of said soils from said surface on next-time cleaning.

The present invention also encompasses a liquid hard-surface cleaning composition comprising a dicapped polyalkoxylene glycol of the formula $R_1$—O—($CH_2$—$CHR_2O$)$_n$—$R_3$, wherein the substituents $R_1$ and $R_3$ each independently are substituted or unsubstituted, saturated or unsaturated, linear or branched hydrocarbon chains having from 1 to 30 carbon atoms, or amino bearing linear or branched, substituted or unsubstituted hydrocarbon chains having from 1 to 30 carbon atoms, $R_2$ is hydrogen or a linear or branched hydrocarbon chain having from 1 to 30 carbon atoms, and wherein n is an integer greater than 0, with the proviso that when both the substituents $R_1$ and $R_3$ each independently are substituted or unsubstituted, saturated or unsaturated, linear or branched hydrocarbon chains having from 1 to 30 carbon atoms and $R_2$ is hydrogen or a linear or branched hydrocarbon chain having from 1 to 30 carbon atoms, then n is greater than 20.

The present invention further encompasses a process of cleaning hard-surfaces wherein a liquid composition as defined herein above, is contacted with said surfaces.

DETAILED DESCRIPTION OF THE INVENTION

In its broadest embodiment, the present invention encompasses the use of a dicapped polyalkoxylene glycol as defined herein, in a liquid composition, to inhibit adherence of soils on a hard-surface after said surface has been first treated with said composition, thereby facilitating the removal of soils from said surface on next-time cleaning.

By "treated", it is meant herein that the hard-surface has been contacted with said liquid composition either in its neat or diluted form, optionally rinsed, and left to dry at ambiant temperature, or dried by any conventional means, e.g. a towel.

An essential ingredient of the present invention is a dicapped polyalkoxylene glycol or mixture thereof as defined herein after. Typically, such a dicapped polyalkoxylene glycol or mixture thereof is used in a liquid composition at a level of from 0.001% to 20% by weight of the total composition, preferably from 0.01% to 5%, more preferably from 0.1% to 4% and most preferably from 0.2% to 3%.

Suitable dicapped polyalkoxylene glycols to be used herein are according to the formula $R_1$—O—($CH_2$—$CHR_2O$)$_n$—$R_3$, wherein the substituents $R_1$ and $R_3$ each independently are substituted or unsubstituted, saturated or unsaturated, linear or branched hydrocarbon chains having from 1 to 30 carbon atoms, or amino bearing linear or branched, substituted or unsubstituted hydrocarbon chains having from 1 to 30 carbon atoms, $R_2$ is hydrogen or a linear or branched hydrocarbon chain having from 1 to 30 carbon atoms, and wherein n is an integer greater than 0.

Typically $R_1$ and $R_3$ each independently are substituted or unsubstituted, saturated or unsaturated, linear or branched alkyl groups, alkenyl groups or aryl groups having from 1 to 30 carbon atoms, preferably from 1 to 16, more preferably from 1 to 8 and most preferably from 1 to 4, or amino bearing linear or branched, substituted or unsubstituted alkyl groups, alkenyl groups or aryl groups having from 1 to 30 carbon atoms, more preferably from 1 to 16, even more preferably from 1 to 8 and most preferably from 1 to 4. Typically $R_2$ is hydrogen, or a linear or branched alkyl group, alkenyl group or aryl group having from 1 to 30 carbon atoms, preferably from 1 to 16, more preferably from 1 to 8, and most preferably is methyl, or hydrogen. Preferably n is an integer above 20, more preferably above 30 up to 70, even more preferably from 32 to 60 and most preferably from 35 to 50.

The preferred dicapped polyalkoxylene glycols to be used according to the present invention have a molecular weight of at least 200, preferably from 400 to 5000, more preferably from 800 to 3000 and most preferably from 1500 to 2500.

Particularly suitable dicapped polyalkoxylene glycols to be used herein include O,O'-bis(2-aminopropyl) polyethylene glycol (MW 2000), O,O'-bis(2-aminopropyl) polyethylene glycol (MW 400), O,O'-dimethyl polyethylene glycol (MW 2000), dimethyl polyethylene glycol (MW 2000), or mixtures thereof.

Preferred dicapped polyalkoxylene glycol for use herein is dimethyl polyethylene glycol (MW 2000).

For instance, dimethyl polyethylene glycol may be commercially available from Hoescht as the polyglycol series, e.g. PEG DME-2000®, or from Huntsman under the name Jeffamine® and XTJ®.

In the embodiment of the present invention wherein the dicapped polyalkoxylene glycol is an amino dicapped polyalkoxylene glycol it is preferred for cleaning performance reasons to formulate the liquid compositions comprising it at a pH equal or lower than the pKa of said amino dicapped polyalkoxylene glycol. Indeed, it has been found that the next-time cleaning performance is especially improved at those pHs when the compositions used according to the present invention comprise such an amino dicapped polyalkoxylene glycol, as the dicapped polyalkoxylene glycol.

The non-amino dicapped polyalkoxylene glycols, as defined herein are pH independent, i.e., the pH of the composition has no influence on the next-time cleaning performance delivered by a composition comprising such a non-amino dicapped polyalkoxylene glycol, as the dicapped polyalkoxylene glycol.

By "amino dicapped polyalkoxylene glycol", it is meant herein a dicapped polyalkoxylene glycol according to the formula $R_1$—O—($CH_2$—$CHR_2O$)$_n$—$R_3$, wherein substituents $R_1$, $R_2$, $R_3$ and n are as defined herein before, and wherein at least substituent $R_1$ or $R_3$ is an amino bearing linear or branched, substituted or unsubstituted hydrocarbon chain of from 1 to 30 carbon atoms.

By "non-amino dicapped polyalkoxylene glycol", it is meant herein a dicapped polyalkoxylene glycol according to the formula $R_1$—O—($CH_2$—$CHR_2O$)$_n$—$R_3$, wherein substituents $R_1$, $R_2$, $R_3$ and n are as defined herein before, and wherein none of the substituents $R_1$ or $R_3$ is an amino bearing linear or branched, substituted or unsubstituted hydrocarbon chain of from 1 to 30 carbon atoms.

The present invention is based on the finding that the use of such a dicapped polyalkoxylene glycol, in a liquid hard-surface cleaning composition, provides improved next-time cleaning performance when a hard-surface has been first treated with said composition. Indeed, it has surprisingly been found that dicapping a polyalkoxylene glycol imparts improved antisoiling properties to such a compound, as compared to the corresponding non-capped polyalkoxylene glycol, or non-capped polyalkoxylene glycol of equal molecular weight.

Although not wishing to be bound by theory, it is speculated that the dicapped polyalkoxylene glycols as defined herein have in common the property of adsorbing to a hard-surface being first treated therewith, in such a manner that a hygroscopic layer is left behind. The resulting hygroscopic layer can attract and retain ambient atmospheric water vapor to more effectively reduce adhesion of soils once treated and thus facilitate removal of said soils subsequently deposited thereon, i.e. less work (e.g. less scrubbing and/or wiping and/or less chemical action) is required to remove the soils in the next-time cleaning operation, as compared to a similar soiled hard-surface which has been first treated with the same compositions without said dicapped polyalkoxylene glycol.

Furthermore, it has surprisingly been found that this next-time cleaning benefit can be obtained at low total level of antiresoiling ingredients. Thus, in a preferred embodiment the compositions herein comprise from 0.2% to 2% by weight of the total composition of the dicapped polyalkoxylene glycol or a mixture thereof, preferably from 0.5% to 2%, and more preferably from 0.5% to 1%.

An advantage of the compositions of the present invention is that good first time cleaning performance is also obtained, as well as a good surface appearance after cleaning.

By "cleaning performance", it is meant herein cleaning on various types of soils including greasy soils like kitchen grease and/or burnt/sticky food residues typically found in a kitchen (e.g., burnt milk). The next-time cleaning benefit is particularly noticeable on greasy soils.

The first time dilute cleaning performance may be evaluated by the following test method: Tiles of enamel, vinyl or ceramic are prepared by applying to them a representative grease/particulate artificial soil, followed by aging. The test compositions and the reference composition are diluted (e.g., composition:water 1:50 or 1:100), applied to a sponge, and used to clean the tiles with a Sheen scrub tester. The number of strokes required to clean to 100% clean is recorded. A minimum of 6 replicates can be taken with each result being generated in duplicate against the reference on each soiled tile.

The next-time dilute cleaning performance may be evaluated by the following test method: Following the procedure detailed for first time cleaning the tiles used for this previous test are taken and resoiled directly without first being further washed or rinsed. The cleaning procedure is then repeated using the Sheen scrub tester, taking care that the test compositions are used to clean the same part of the tile as was previously cleaned by them. The number of strokes required to clean to 100% clean is recorded. A minimum of 6 replicates can be taken with each result being generated in duplicate against the reference on each soiled tile. This resoiling and cleaning procedure can be repeated up to 5 times.

The test method for evaluating neat cleaning performance is identical to above except that the test compositions and reference are used undiluted and that after cleaning a rinsing cycle is performed with clean water. This rinsing cycle may be repeated up to 5 times prior to the resoiling step for next time cleaning evaluation.

The liquid compositions used according to the present invention preferably are aqueous compositions comprising different optional ingredients as defined herein after.

The Liquid Compositions:

The compositions according to the present invention particularly suitable for the cleaning of a hard-surface, are liquid compositions. The liquid compositions of the present invention are preferably, but not necessarily formulated as aqueous compositions. Aqueous compositions typically comprise from 50% to 99% by weight of the total composition of water, preferably from 60% to 95%, and more preferably from 80% to 95%.

The liquid compositions herein may be formulated in the full pH range of 0 to 14, preferably 1 to 13. Typically, the compositions herein are formulated in a neutral to highly alkaline pH range from 7 to 13, preferably from 9 to 11 and more preferably from 9.5 to 11. The pH of the compositions herein can be adjusted by any of the means well-known to those skilled in the art such as acidifying agents like organic or inorganic acids, or alkalinising agents like NaOH, KOH, K2CO3, Na2CO3 and the like. Preferred organic acids for use herein have a pk of less than 6. Suitable organic acids are selected from the group consisting of citric acid, lactic acid, glycolic acid, succinic acid, glutaric acid and adipic acid and mixtures thereof. A mixture of said acids may be commercially available from BASF under the trade name Sokalan® DCS.

As an essential ingredient the liquid compositions herein comprise a dicapped polyalkoxylene glycol or mixtures thereof.

Suitable dicapped polyalkoxylene glycols to be used in the compositions of the present invention have the formula $$R_1—O—(CH_2—CHR_2O)_n—R_3$$

wherein the substituents $R_1$ and $R_3$ each independently are substituted or unsubstituted, saturated or unsaturated, linear or branched hydrocarbon chains having from 1 to 30 carbon atoms, or amino bearing linear or branched, substituted or unsubstituted hydrocarbon chains having from 1 to 30 carbon atoms, $R_2$ is hydrogen or a linear or branched hydrocarbon chain having from 1 to 30 carbon atoms, and wherein n is an integer greater than 0, with the proviso that when both the substituents $R_1$ and $R_3$ independently are substituted or unsubstituted, saturated or unsaturated, linear or branched hydrocarbon chains having from 1 to 30 carbon atoms and R2is hydrogen or a linear or branched hydrocarbon chain having from 1 to 30 carbon atoms, then n is greater than 20.

Preferred dicapped polyalkoxylene glycols for use herein are as described herein before.

The present invention is based on the finding that the liquid compositions of the present invention comprising a dicapped polyalkoxylene glycol as defined herein provide improved next-time cleaning performance when treating a hard-surface therewith, as compared to the next-time cleaning performance delivered with the same compositions, but without said antiresoiling ingredient or with another antiresoiling polymer like a poly-(trimethyl aminoethyl) methacrylate.

Optional Ingredients:

The liquid compositions according to the present invention may comprise a variety of optional ingredients depending on the technical benefit aimed for and the surface treated.

Suitable optional ingredients for use herein include surfactants, builders, chelants, polymers, solvents, buffers, bactericides, hydrotropes, colorants, stabilisers, radical scavengers, bleaches, bleach activators, sud controlling agents like fatty acids, enzymes, soil suspenders, dye transfer agents, brighteners, anti dusting agents, dispersants, dye transfer inhibitors, pigments, dyes and/or perfumes.

The liquid compositions of the present invention preferably comprise a surfactant, or mixtures thereof. Said surfactant may be present in the compositions according to the present invention in amounts of from 0.1% to 50% by weight of the total composition, preferably of from 0.1% to 20% and more preferably of from 1% to 10%.

Surfactants are desired herein as they further contribute to the cleaning performance and/or gloss benefit of the compositions of the present invention. Surfactants to be used herein include nonionic surfactants, anionic surfactants, cationic surfactants, amphoteric surfactants, zwitterionic surfactants, and mixtures thereof.

Particularly preferred surfactants are the nonionic surfactants. Suitable nonionic surfactants for use herein include a class of compounds which may be broadly defined as compounds produced by the condensation of alkylene oxide groups (hydrophilic in nature) with an organic hydrophobic compound, which may be branched or linear aliphatic (e.g. Guerbet or secondary alcohols) or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

For example, a well-known class of nonionic synthetic detergents is made available on the market under the trade name "Pluronic". These compounds are formed by condensing ethylene oxide with an hydrophobic base formed by the condensation of propylene oxide with propylene glycol. The hydrophobic portion of the molecule which, of course, exhibits water-insolubility has a molecular weight of from about 1500 to 1800. The addition of polyoxyethylene radicals to this hydrophobic portion tends to increase the water-solubility of the molecule as a whole and the liquid character of the products is retained up to the point where polyoxyethylene content is about 50% of the total weight of the condensation product.

Other suitable nonionic synthetic detergents include:

(i) The polyethylene oxide condensates of alkyl phenols, e.g., the condensation products of alkyl phenols having an alkyl group containing from about 6 to 12 carbon atoms in either a straight chain or branched chain configuration, with ethylene oxide, the said ethylene oxide being present in amounts equal to 10 to 25 moles of ethylene oxide per mole of alkyl phenol. The alkyl substituent in such compounds may be derived from polymerized propylene, diisobutylene, octane, and nonane;

(ii) Those derived from the condensation of ethylene oxide with the product resulting from the reaction of propylene oxide and ethylene diamine products which may be varied in composition depending upon the balance between the hydrophobic and hydrophilic elements which is desired.

Examples are compounds containing from about 40% to about 80% polyoxyethylene by weight and having a molecular weight of from about 5000 to about 11000 resulting from the reaction of ethylene oxide groups with a hydrophobic base constituted of the reaction product of ethylene diamine and excess propylene oxide, said base having a molecular weight of the order of 2500 to 3000;

(iii) The condensation product of aliphatic alcohols having from 8 to 18 carbon atoms, in either straight chain or branched chain configuration, with ethylene oxide, e.g., a coconut alcohol ethylene oxide condensate having from 10 to 30 moles of ethylene oxide per mole of coconut alcohol, the coconut alcohol fraction having from 10 to 14 carbon atoms;

(iv) Trialkyl amine oxides and trialkyl phosphine oxides wherein one alkyl group ranges from 10 to 18 carbon atoms and two alkyl groups range from 1 to 3 carbon atoms; the alkyl groups can contain hydroxy substituents; specific examples are dodecyl di(2-hydroxyethyl)amine oxide and tetradecyl dimethyl phosphine oxide.

Also useful as a nonionic surfactant are the alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and polysaccharide, e.g., a polyglycoside. hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose, and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6- positions of the preceding saccharide units.

Optionally, and less desirably, there can be a polyalkkyleneoxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group can contain up to about 3 hydroxy groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

The preferred alkylpolyglycosides have the formula:

$$R^2O(C_nH_{2n}O)_t(\text{glucosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4 and/or 6-position, preferably predominantly the 2- position.

Although not preferred, the condensation products of ethylene oxide with a hydrophobic base formed by the condensation of propylene oxide with propylene glycol are also suitable for use herein. The hydrophobic portion of these compounds will preferably have a molecular weight of from about 1500 to about 1800 and will exhibit water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially available Pluronic™ surfactants, marketed by BASF.

Also not preferred, although suitable for use as nonionic surfactants herein are the condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5000 to about 11000.

Examples of this type of nonionic surfactant include certain of the commercially available Tetronic™ compounds, marketed by BASF.

Other suitable nonionic surfactants for use herein include polyhydroxy fatty acid amides of the structural formula

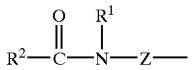

(I)

wherein: $R^1$ is H, $C_1$–$C_4$ hydrocarbyl, 2-hydroxy ethyl, 2-hydroxypropyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup can be utilised as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $CH(CH_2OH)—(CHOH)_{n-1}—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl.

$R^2$—CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

In one embodiment herein suitable nonionic surfactants to be used are polyethylene oxide condensates of alkyl phenols, condensation products of primary and secondary aliphatic alcohols with from about 1 to about 25 moles of ethyelene oxide, alkylpolysaccharides, and mixtures thereof. Most preferred are $C_8$–$C_{14}$ alkyl phenol ethoxylates having from 3 to 15 ethoxy groups and $C_8$–$C_{18}$ alcohol ethoxylates (preferably $C_{10}$ avg.) having from 2 to 10 ethoxy groups, and mixtures thereof.

Particularly preferred surfactants include also the anionic surfactants. Suitable anionic surfactants for use herein include alkali metal (e.g., sodium or potassium) fatty acids, or soaps thereof, containing from about 8 to about 24, preferably from about 10 to about 20 carbon atoms.

The fatty acids including those used in making the soaps can be obtained from natural sources such as, for instance, plant or animal-derived glycerides (e.g., palm oil, coconut oil, babassu oil, soybean oil, castor oil, tallow, whale oil, fish oil, tallow, grease, lard and mixtures thereof). The fatty acids can also be synthetically prepared (e.g., by oxidation of petroleum stocks or by the Fischer-Tropsch process).

Alkali metal soaps can be made by direct saponification of fats and oils or by the neutralization of the free fatty acids which are prepared in a separate manufacturing process. Particularly useful are the sodium and potassium salts of the mixtures of fatty acids derived from coconut oil and tallow, i.e. sodium and potassium tallow and coconut soaps.

The term "tallow" is used herein in connection with fatty acid mixtures which typically have an approximate carbon chain length distribution of 2.5% C14, 29% C16, 23% C18, 2% palmitoleic, 41.5% oleic and 3% linoleic (the first three fatty acids listed are saturated). Other mixtures with similar distribution, such as the fatty acids derived from various animal tallows and lard, are also included within the term tallow. The tallow can also be hardened (i.e., hydrogenated) to convert part or all of the unsaturated fatty acid moieties to saturated fatty acid moieties.

When the term "coconut" is used herein it refers to fatty acid mixtures which typically have an approximate carbon chain length distribution of about 8% C8, 7% C10, 48% C12, 17% C14, 9% C16, 2% C18, 7% oleic, and 2% linoleic (the first six fatty acids listed being saturated). Other sources having similar carbon chain length distribution such as palm kernel oil and babassu oil are included with the term coconut oil.

Other suitable anionic surfactants for use herein include water-soluble salts, particularly the alkali metal salts, of organic sulfuric reaction products having in the molecular structure an alkyl radical containing from about 8 to about 22 carbon atoms and a radical selected from the group consisting of sulfonic acid and sulfuric acid ester radicals. Important examples of these synthetic detergents are the sodium, ammonium or potassium alkyl sulfates, especially those obtained by sulfating the higher alcohols produced by reducing the glycerides of tallow or coconut oil; sodium or potassium alkyl benzene sulfonates, in which the alkyl group contains from about 9 to about 15 carbon atoms, especially those of the types described in U.S. Pat. Nos. 2,220,099 and 2,477,383, incorporated herein by reference; sodium alkyl glyceryl ether sulfonates, especially those ethers of the higher alcohols derived from tallow and coconut oil; sodium coconut oil fatty acid monoglyceride sulfates and sulfonates: sodium or potassium salts of sulfuric acid esters of the reaction product of one mole of a higher fatty alcohol (e.g., tallow or coconut oil alcohols) and about three moles of ethylene oxide; sodium or potassium salts of alkyl phenol ethylene oxide ether sulfates with about four units of ethylene oxide per molecule and in which the alkyl radicals contain about 9 carbon atoms; the reaction product of fatty acids esterified with isothionic acid and neutralized with sodium hydroxide where, for example, the fatty acids are derived from coconut oil; sodium or potassium salts of fatty acid amide of a methyl taurine in which the fatty acids, for example, are derived from coconut oil; and others known in the art, a number being specifically set forth in U.S. Pat. Nos. 2,486,921, 2,486,922 and 2,396,278, incorporated herein by reference.

Suitable zwitterionic detergents to be used herein comprise the betaine and betaine-like detergents wherein the molecule contains both basic and acidic groups which form an inner salt giving the molecule both cationic and anionic hydrophilic groups over a broad range of pH values. Some common examples of these detergents are described in U.S. Pat. Nos. 2,082,275, 2,702,279 and 2,255,082, incorporated herein by reference. Preferred zwitterionic detergent compounds have the formula:

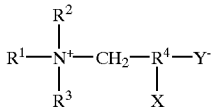

wherein $R_1$ is an alkyl radical containing from 8 to 22 carbon atoms, R2and R3 contain from 1 to 3 carbon atoms, R4 is an alkylene chain containing from 1 to 3 carbon atoms, X is selected from the group consisting of hydrogen and a hydroxyl radical, Y is selected from the group consisting of carboxyl and sulfonyl radicals and wherein the sum of R1, $R_2$and R3 radicals is from 14 to 24 carbon atoms.

Amphoteric and ampholytic detergents which can be either cationic or anionic depending upon the pH of the system are represented by detergents such as dodecylbeta-alanine, N-alkyltaurines such as the one prepared by reacting dodecylamine with sodium isethionate according to the teaching of U.S. Pat. No. 2,658,072, N-higher alkylaspartic acids such as those produced according to the teaching of U.S. Pat. No. 2,438,091, and the products sold under the trade name "Miranol", and described in U.S. Pat. No. 2,528,378, said patents being incorporated herein by reference.

Additional synthetic detergents and listings of their commercial sources can be found in McCutcheon's Detergents and Emulsifiers, North American Ed. 1980, incorporated herein by reference.

Suitable amphoteric surfactants include the amine oxides corresponding to the formula:

R R'R"N→O wherein R is a primary alkyl group containing 6–24 carbons, preferably 10–18 carbons, and wherein R' and R" are, each, independently, an alkyl group containing 1 to 6 carbon atoms. The arrow in the formula is a conventional representation of a semi-polar bond. The preferred amine oxides are those in which the primary alkyl group has a straight chain in at least most of the molecules, generally at least 70%, preferably at least 90% of the molecules, and the amine oxides which are especially preferred are those in which R contains 10–18 carbons and R' and R" are both methyl. Exemplary of the preferred amine oxides are the N-hexyldimethylamine oxide, N-octyldimethylamine oxide, N-decyidimethylamine oxide, N-dodecyldimethylamine oxide, N-tetradecyldimethylamine oxide, N-hexadecyldimethylamine oxide, N-octadecyidimethylamine oxide, N-eicosyldimethylamine oxide, N-docosyldimethylamine oxide, N-tetracosyl dimethylamine oxide, the corresponding amine oxides in which one or both of the methyl groups are replaced with ethyl or 2-hydroxyethyl groups and mixtures thereof. A most preferred amine oxide for use herein is N-decyldimethylamine oxide.

Other suitable amphoteric surfactants for the purpose of the invention are the phosphine or sulfoxide surfactants of formula:

R R'R"A→O wherein A is phosphorus or sulfur atom, R is a primary alkyl group containing 6–24 carbons, preferably 10–18 carbons, and wherein R' and R" are, each, independently selected from methyl, ethyl and 2-hydroxyethyl. The arrow in the formula is a conventional representation of a semi-polar bond.

Cationic surfactants suitable for use in compositions of the present invention are those having a long-chain hydrocarbyl group. Examples of such cationic surfactants include the ammonium surfactants such as alkyldimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from 8 to 18 carbon atoms in the alkyl chain, each $R^3$ is selected from the group consisting of —$CH_2CH_2$—,—$CH_2CH(CH_3)$—, —$CH_2CH(CH_2OH)$—, —$CH_2CH_2CH_2$—, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, $CH_2CHOH$—$CHOHCOR^6CHOHCH_2OH$ wherein $R^6$ is any hexose or hexose polymer having a molecular weight less than about 1000, and hydrogen when y is not 0; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Other cationic surfactants useful herein are also described in U.S. Pat. No. 4,228,044, Cambre, issued Oct. 14, 1980, incorporated herein by reference.

The compositions of the present invention may also include a vinylpyrrolidone homopolymer or copolymer or a mixture thereof. The compositions of the present invention comprise up to 20% by weight of the total composition of a vinylpyrrolidone homopolymer or copolymer or a mixture thereof, preferably from 0.01% to 10%, more preferably from 0.1% to 5% and most preferably from 0.2% to 2%.

Suitable vinylpyrrolidone homopolymers to be used herein is an homopolymer of N-vinylpyrrolidone having the following repeating monomer:

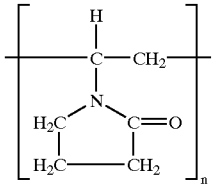

wherein n (degree of polymerisation) is an integer of from 10 to 1,000,000, preferably from 20 to 100,000, and more preferably from 20 to 10,000.

Accordingly, suitable vinylpyrrolidone homopolymers ("PVP") for use herein have an average molecular weight of from 1,000 to 100,000,000, preferably from 2,000 to 10,000,000, more preferably from 5,000 to 1,000,000, and most preferably from 50,000 to 500,000.

Suitable vinylpyrrolidone homopolymers are commercially available from ISP Corporation, New York, N.Y. and Montreal, Canada under the product names PVP K-15 (viscosity molecular weight of 10,000), PVP K-30 (average molecular weight of 40,000), PVP K-60 (average molecular weight of 160,000), and PVP K-90 (average molecular weight of 360,000). Other suitable vinylpyrrolidone homopolymers which are commercially available from BASF Cooperation include Sokalan HP 165 and Sokalan HP 12; vinylpyrrolidone homopolymers known to persons skilled in the detergent field (see for example EP-A-262,897 and EP-A256,696).

Suitable copolymers of vinylpyrrolidone for use herein include copolymers of N-vinylpyrrolidone and alkylenically unsaturated monomers or mixtures thereof.

Alkylenically unsaturated monomers which may be used to prepare the copolymers include unsaturated dicarboxylic acids such as maleic acid, chloromaleic acid, fumaric acid, itaconic acid, citraconic acid, phenylmaleic acid, aconitic acid, acrylic acid, N-vinylimidazole and vinyl acetate. Any of the anhydrides of the unsaturated acids may be employed, for example methacrylate. Aromatic monomers like styrene, sulphonated styrene, alphamethyl styrene, vinyl toluene, t-butyl styrene and similar well known monomers may be used.

The molecular weight of the copolymer of vinylpyrrolidone is not especially critical so long as the copolymer is water-soluble, has some surface activity and is adsorbed to the hard-surface from the liquid composition or solution (i.e. under dilute usage conditions) comprising it in such a manner as to increase the hydrophilicity of the surface. However, the preferred copolymers of N-vinylpyrrolidone and alkylenically unsaturated monomers or mixtures thereof, have a molecular weight of between 1,000 and 1,000,000, preferably between 10,000 and 500,000 and more preferably between 10,000 and 200,000.

For example, particularly suitable N-vinylimidazole N-vinylpyrrolidone polymers for use herein have an average molecular weight range from 5,000–1,000,000, preferably from 5,000 to 500,000, and more preferably from 10,000 to 200,000. The average molecular weight range was determined by light scattering as described in Barth H. G. and Mays J. W. Chemical Analysis Vol 113, "Modern Methods of Polymer Characterization".

Such copolymers of N-vinylpyrrolidone and alkylenically unsaturated monomers like PVP/vinyl acetate copolymers are commercially available under the trade name Luviskol® series from BASF.

Particular preferred copolymers of vinylpyrrolidone for use in the compositions of the present invention are quaternized or unquaternized vinylpyrrolidone/dialkylaminoalkyl acrylate or methacrylate copolymers.

The vinylpyrrolidone/dialkylaminoalkyl acrylate or methacrylate copolymers (quaternised or unquaternised) suitable to be used in the compositions of the present invention are according to the following formula:

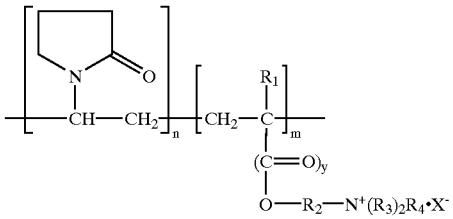

in which n is between 20 and 99 and preferably between 40 and 90 mol % and m is between 1 and 80 and preferably between 5 and 40 mol %; $R_1$ represents H or $CH_3$; y denotes 0 or 1; $R_2$ is —$CH_2$—CHOH—$CH_2$— or $C_xH_{2x}$, in which x=2 to 18; $R_3$ represents a lower alkyl group of from 1 to 4 carbon atoms, preferably methyl or ethyl, or

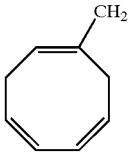

$R_4$ denotes a lower alkyl group of from 1 to 4 carbon atoms, preferably methyl or ethyl; $X^-$ is chosen from the group consisting of Cl, Br, I, $1/2SO_4$, $HSO_4$ and $CH_3SO_3$.

The polymers can be prepared by the process described in French Pat. Nos. 2,077,143 and 2,393,573.

The preferred quaternized or unquaternized vinylpyrrolidone/dialkylaminoalkyl acrylate or methacrylate copolymers for use herein have a molecular weight of between 1,000 and 1,000,000, preferably between 10,000 and 500,000 and more preferably between 10,000 and 100,000.

Such vinylpyrrolidone/dialkylaminoalkyl acrylate or methacrylate copolymers are commercially available under the name copolymer 845®, Gafquat 734®, or Gafquat 755® from ISP Corporation, New York, N.Y. and Montreal, Canada or from BASF under the tradename Luviquat®.

Most preferred herein is quaternized copolymers of vinyl pryrrolidone and dimethyl aminoethymethacrylate (polyquaternium-11) available from BASF.

These vinylpyrrolidone homopolymers and/or copolymers contribute to the benefit of the compositions of the present invention, i.e. they help improving the next-time cleaning performance, but also the first time cleaning performance.

Thus, in a preferred embodiment the composition of the present invention further comprise a vinylpyrrolidone homopolymer and/or copolymer on top of said dicapped polyalkoxylene glycol. More particularly, it has surprisingly been found that there is a synergistic effect on next-time cleaning performance associated with the use of a dicapped polyalkoxylene glycol together with a vinylpyrrolidone homopolymer and/or copolymer.

The liquid compositions of the present invention may further comprise other antiresoiling ingredients like a polyalkoxylene glycol according to the formula H—O—$(CH_2$—$CHR_2O)_n$—H, and/or a monocapped polyalkoxylene glycol of the formula $R_1$—O—$(CH_2$—$CHR_2O)_n$—H, wherein the substituent $R_1$ is a substituted or unsubstituted, saturated or unsaturated, linear or branched hydrocarbon chain having from 1 to 30 carbon atoms, or an amino bearing linear or branched. substituted or unsubstituted hydrocarbon chain having from 1 to 30 carbon atoms, $R_2$ is hydrogen or a linear or branched hydrocarbon chain having from 1 to 30 carbon atoms, and wherein n is an integer greater than 0.

Preferably $R_1$ is a substituted or unsubstituted, saturated or unsaturated, linear or branched alkyl group, alkenyl group or aryl group having from 1 to 30 carbon atoms, preferably from 1 to 16, more preferably from 1 to 8 and most preferably from 1 to 4, or an amino bearing linear or branched, substituted or unsubstituted alkyl group, alkenyl group or aryl group having from 1 to 30 carbon atoms, more preferably from 1 to 16, even more preferably from 1 to 8 and most preferably from 1 to 4. Preferably $R_2$ is hydrogen, or a linear or branched alkyl group, alkenyl group or aryl group having from 1 to 30 carbon atoms, more preferably from 1 to 16, even more preferably from 1 to 8, and most preferably $R_2$ is methyl, or hydrogen. Preferably n is an integer from 5 to 1000, more preferably from 10 to 100, even more preferably from 20 to 60 and most preferably from 30 to 50.

The compositions of the present invention may comprise up to 20% by weight of the total composition of said polyalkoxylene glycols and/or monocapped polyalkoxylene glycols on top of said dicapped polyalkoxylene glycols, preferably from 0.01% to 10%, more preferably from 0.1% to 5%.

Suitable monocapped polyalkoxylene glycols to be used herein include 2-aminopropyl polyethylene glycol (MW 2000), methyl polyethylene glycol (MW 1800) and the like. Such monocapped polyalkoxylene glycols may be commercially available from Hoescht under the polyglycol series or Hunstman under the tradename XTJ®. Preferred polyalkoxylene glycols to be used herein are polyethylene glycols like polyethylene glycol (MW 2000).

The compositions herein may further comprise other polymeric compounds, up to a level of 20% by weight of the total composition, preferably 0.01% to 5%, like carboxylate-containing polymer, or mixtures thereof.

By "carboxylate-containing polymer", it is meant herein a polymer or copolymer comprising at least a monomeric unit, which contains at least a carboxylate functionality. Any carboxylate-containing polymer known to those skilled in the art can be employed according to the present invention such as homo- or co-polymeric polycarboxylic acids or their salts including polyacrylates and polymers and copolymers of maleic anhydride or/and acrylic acid and the like, or mixtures thereof. Indeed, such carboxylate-containing polymers can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable.

Particularly Suitable polymeric polycarboxylates can be derived from acrylic acid. Such acrylic acid-based polymers which are useful herein are the water-soluble salts of polymerized acrylic acid. The average molecular weight of such polymers in the acid form preferably ranges from about 2,000 to 1,000,000, more preferably from about 10,000 to 150,000 and most preferably from about 20,000 to 100,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred carboxylate-containing polymer. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982. Particularly preferred is a copolymer of maleic/acrylic acid with an average molecular weight of about 70,000. Such copolymers are commercially available from BASF under the trade name SOKALAN CP5.

Other suitable carboxylate-containing polymers to be used herein include cellulose derivatives such as carboxymethylcellulose. For example carboxymethylcellulose may be used as a salt with conventional cation such as sodium, potassium, amines or substituted amines.

The compositions according to the present invention may further comprise a divalent counterion, or mixtures thereof. All divalent ions known to those skilled in the art may be used herein. Preferred divalent ions to be used herein are calcium, zinc, cadmium, nickel, copper, cobalt, zirconium, chromium and/or magnesium and more preferred are calcium, zinc and/or magnesium. Said divalent ions may be added in the form of salts for example as chloride, acetate, sulphate, formate and/or nitrate or as a complex metal salt. For example, calcium may be added in the form of calcium chloride. magnesium as magnesium acetate or magnesium sulphate and zinc as zinc chloride.

In one embodiment of the present invention said carboxylate-containing polymer and said divalent counterion may be added as one ingredient provided that the molar ratio of said carboxylate-containing polymer to said divalent counterion/salt is from 12:1 to 1:32.

In the embodiment herein wherein said carboxylic-containing polymer and said divalent counterion are present in the compositions herein they are preferably present at a molar ratio of said polymer to said divalent counterion of from 12:1 to 1:32, more preferably of from 8:1 to 1.16, and most preferably of from 4:1 to 1:6. Preferred molar ratios of said polymer to said divalent counterion are those where excellent gloss is obtained in the most economic way.

The liquid compositions of the present invention may also comprises a builder or a mixture thereof, as an optional ingredeint. Suitable builders for use herein include polycarboxylates and polyphosphates, and salts thereof. Typically, the compositions of the present invention comprise up to 20% by weight of the total composition of a builder or mixtures thereof, preferably from 0.1% to 10%, and more preferably from 0.5% to 5%.

Suitable and preferred polycarboxylates for use herein are organic polycarboxylates where the highest LogKa, measured at 25° C./0.1M ionic strength is between 3 and 8, wherein the sum of the LogKCa+LogKMg, measured at 25° C./0.1M ionic strength is higher than 4, and wherein LogKCa=LogKMg±2 units, measured at 25° C./0.1M ionic strength.

Such suitable and preferred polycarboxylates include citrate and complexes of the formula:

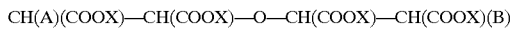

$$CH(A)(COOX)—CH(COOX)—O—CH(COOX)—CH(COOX)(B)$$

wherein A is H or OH; B is H or —O—CH(COOX)—$CH_2$(COOX); and X is H or a salt-forming cation. For example, if in the above general formula A and B are both H, then the compound is oxydissuccinic acid and its water-soluble salts. If A is OH and B is H, then the compound is tartrate monosuccinic acid (TMS) and its water-soluble salts. If A is H and B is —O—CH(COOX)—$CH_2$(COOX), then the compound is tartrate disuccinic acid (TDS) and its water-soluble salts. Mixtures of these builders are especially preferred for use herein. Particularly TMS to TDS, these builders are disclosed in U.S. Pat. No. 4,663,071, issued to Bush et al., on May 5, 1987.

Still other ether polycarboxylates suitable for use herein include copolymers of maleic anhydride with ethylene or vinyl methyl ether, 1,3,5-trihydroxy benzene-2,4,6-trisulfonic acid, and carboxymethyloxysuccinic acid.

Other useful polycarboxylate builders include the ether hydroxypolycarboxylates represented by the structure:

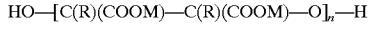

$$HO—[C(R)(COOM)—C(R)(COOM)—O]_n—H$$

wherein M is hydrogen or a cation wherein the resultant salt is water-soluble, preferably an alkali metal, ammonium or substituted ammonium cation, n is from about 2 to about 15 (preferably n is from about 2 to about 10, more preferably n averages from about 2 to about 4) and each R is the same or different and selected from hydrogen, $C_{1-4}$ alkyl or $C_{1-4}$ substituted alkyl (preferably R is hydrogen).

Suitable ether polycarboxylates also include cyclic compounds, particularly alicyclic compounds, such as those described in U.S. Pat. Nos. 3,923,679; 3,835,163; 4,158,635; 4,120,874 and 4,102,903, all of which are incorporated herein by reference.

Preferred amongst those cyclic compounds are dipicolinic acid and chelidanic acid.

Also suitable polycarboxylates for use herein are mellitic acid, succinic acid, polymaleic acid, benzene 1,3,5-tricarboxylic acid, benezene pentacarboxylic acid, and carboxymethyloxysuccinic acid, and soluble salts thereof.

Still suitable carboxylate builders herein include the carboxylated carbohydrates disclosed in U.S. Pat. No. 3,723,322, Diehl, issued Mar. 28, 1973, incorporated herein by reference.

Other suitable carboxylates for use herein, but which are less preferred because they do not meet the above criteria are alkali metal, ammonium and substituted ammonium salts of polyacetic acids. Examples of polyacetic acid builder salts are sodium, potassium, lithium, ammonium and substituted ammonium salts of ethylenediamine, tetraacetic acid and nitrilotriacetic acid.

Other suitable, but less preferred polycarboxylates are those also known as alkyliminoacetic builders, such as methyl imino diacetic acid, alanine diacetic acid, methyl glycine diacetic acid, hydroxy propylene imino diacetic acid and other alkyl imino acetic acid builders.

Also suitable in the compositions of the present invention are the 3,3-dicarboxy-4-oxa-1,6-hexanediotes and the related compounds disclosed in U.S. Pat. No. 4,566,984, Bush, issued Jan. 28, 1986, incorporated herein by reference. Useful succinic acid builders include the C5–C20 alkyl succinic acids and salts thereof. A particularly preferred compound of this type is dodecenylsuccinic acid. Alkyl succinic acids typically are of the general formula R—CH(COOH)$CH_2$(COOH) i.e., derivatives of succinic acid, wherein R is hydrocarbon, e.g., $C_{10}$–$C_{20}$ alkyl or alkenyl, preferably $C_{12}$–$C_{16}$ or wherein R may be substituted with hydroxyl, sulfo, sulfoxy or sulfone substituents, all as described in the above-mentioned patents.

The succinate builders are preferably used in the form of their water-soluble salts, including the sodium, potassium, ammonium and alkanolammonium salts.

Specific examples of succinate builders include laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0 200 263, published Nov. 5, 1986.

Examples of useful builders also include sodium and potassium carboxymethyloxymalonate, carboxymethyloxysuccinate, cis-cyclohexanehexacarboxylate, cis-cyclopentanetetracarboxylate, water-soluble polyacrylates and the copolymers of maleic anhydride with vinyl methyl ether or ethylene.

Other suitable polycarboxylates are the polyacetal carboxylates disclosed in U.S. Pat. No. 4,144,226, Crutchfield et al., issued Mar. 13, 1979, incorporated herein by reference. These polyacetal carboxylates can be prepared by bringing together, under polymerization conditions, an ester of glyoxylic acid and a polyerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Polycarboxylate builders are also disclosed in U.S. Pat. No. 3,308,067, Diehl, issued Mar. 7, 1967, incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

Suitable polyphosphonates for use herein are the alkali metal, ammonium and alkanolammonium salts of polyphosphates (exemplified by the tripolyphosphates, pyrophosphates, and glassy polymeric meta-phosphates), phosphonates. The most preferred builder for use herein is citrate.

Suitable perfumes to be used herein include materials which provide an olfactory aesthetic benefit and/or cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients provide a fresh and clean impression to the surfaces, and it is desirable that these ingredients be deposited and present on the dry surface. Perfume ingredients can be readily solubilized in the compositions, for instance by the nonionic detergent surfactants.

The perfume ingredients and compositions suitable to be used herein are the conventional ones known in the art. Selection of any perfume component, or amount of perfume, is based solely on aesthetic considerations.

Suitable perfume compounds and compositions can be found in the art including U.S. Pat. No. : 4,145,184, Brain and Cummins, issued Mar. 20, 1979. U.S. Pat. No. 4,209,417, Whyte, issued Jun. 24, 1980; U.S. Pat. No. 4,515,705, Moeddel, issued May 7, 1985; and U.S. Pat. No. 4,152,272, Young, issued May 1, 1979, all of said patents being incorporated herein by reference.

In general, the degree of substantivity of a perfume is roughly proportional to the percentages of substantive perfume material used. Relatively substantive perfumes contain at least about 1%, preferably at least about 10%, substantive perfume materials.

Substantive perfume materials are those odorous compounds that deposit on surfaces via the cleaning process and are detectable by people with normal olfactory acuity. Such materials typically have vapor pressures lower than that of the average perfume material. Also, they typically have molecular weights of about 200 and above, and are detectable at levels below those of the average perfume material.

Perfume ingredients useful herein, along with their odor character, and their physical and chemical properties, such as boiling point and molecular weight, are given in "Perfume and Flavor Chemicals (Aroma Chemicals)," Steffen Arctander, published by the author, 1969, incorporated herein by reference.

Examples of the highly volatile, low boiling, perfume ingredients are: anethole, benzaldehyde, benzyl acetate, benzyl alcohol, benzyl formate, iso-bornyl acetate, camphene, ciscitral (neral), citronellal, citronellol, citronellyl acetate, para-cymene, decanal, dihydrolinalool, dihydromyrcenol, dimethyl phenyl carbinol, eucaliptol, geranial, geraniol, geranyl acetate, geranyl nitrile, cis-3-hexenyl acetate, hydroxycitronellal, d-limonene, linalool, linalool oxide, linalyl acetate, linalyl propionate, methyl anthranilate, alpha-methyl ionone, methyl nonyl acetaldehyde, methyl phenyl carbinyl acetate, laevo-menthyl acetate, menthone, iso-menthone, mycrene, myrcenyl acetate, myrcenol, nerol, neryl acetate, nonyl acetate, phenyl ethyl alcohol, alpha-pinene, beta-pinene, gamma-terpinene, alpha-terpineol, beta-terpineol, terpinyl acetate, and vertenex (paratertiary-butyl cyclohexyl acetate). Some natural oils also contain large percentages of highly volatile perfume ingredients. For example, lavandin contains as major components: linalool; linalyl acetate; geraniol; and citronellol. Lemon oil and orange terpenes both contain about 95% of d-limonene.

Examples of moderately volatile perfume ingredients are: amyl cinnamic aldehyde, iso-amyl salicylate, beta-caryophyllene, cedrene, cinnamic alcohol, coumarin, dimethyl benzyl carbinyl acetate, ethyl vanillin, eugenol, iso-eugenol, flor acetate, heliotropine, 3-cis-hexenyl salicylate, hexyl salicylate, lilial (paratertiarybutyl-alpha-methyl hydrocinnamic aldehyde), gamma-methyl ionone, nerolidol, patchouli alcohol, phenyl hexanol, beta-selinene, trichloromethyl phenyl carbinyl acetate, triethyl citrate, vanillin, and veratraldehyde. Cedarwood terpenes are composed mainly of alpha-cedrene, beta-cedrene, and other C15H24 sesquiterpenes.

Examples of the less volatile, high boiling, perfume ingredients are: benzophenone, benzyl salicylate, ethylene brassylate, galaxolide (1,3,4,6,7,8-hexahydro-4,6,6,7,8,8-hexamethyl-cyclopenta-gama-2-benzopyran), hexyl cinnamic aldehyde, lyral (4-(4-hydroxy-4-methyl pentyl)-3-cyclohexene-10-carboxaldehyde), methyl cedrylone, methyl dihydro jasmonate, methyl-betanaphthyl ketone, musk indanone, musk ketone, musk tibetene, and phenylethyl phenyl acetate.

Selection of any particular perfume ingredient is primarily dictated by aesthetic considerations.

The liquid compositions herein may comprise a perfume ingredient, or mixtures thereof, in amounts up to 5.0% by weight of the total composition, preferably in amounts of 0.1% to 1.5%.

Another class of optional compounds to be used herein include chelating agents or mixtures thereof.

Chelating agents can be incorporated in the compositions herein in amounts ranging from 0.0% to 10.0% by weight of the total composition, preferably 0.1% to 5.0%.

Suitable phosphonate chelating agents to be used herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates to be used herein include ethylene diamine tetra acetates, diethylene triamine pentaacetates, diethylene triamine pentaacetate (DTPA), N-hydroxyethylethylenediamine triacetates, nitrilotriacetates, ethylenediamine tetrapropionates, triethylenetetraaminehexa-acetates, ethanol-diglycines, propylene diamine tetracetic acid (PDTA) and methyl glycine diacetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents to be used herein include salicylic acid, aspartic acid, glutamic acid, glycine, malonic acid or mixtures thereof.

The compositions according to the present invention may further comprise a sud controlling agent such as 2-alkyl alkanol, or mixtures thereof, as a preferred optional ingredient. Particularly suitable to be used in the present invention are the 2-alkyl alkanols having an alkyl chain comprising from 6 to 16 carbon atoms, preferably from 8 to 12 and a terminal hydroxy group, said alkyl chain being substituted in the $\alpha$ position by an alkyl chain comprising from 1 to 10 carbon atoms, preferably from 2 to 8 and more preferably 3 to 6. Such suitable compounds are commercially available, for instance, in the Isofol® series such as Isofol® 12 (2-butyl octanol) or Isofol® 16 (2-hexyl decanol). Typically, the compositions herein may comprise up to 2% by weight of the total composition of a 2-alkyl alkanol, or mixtures thereof, preferably from 0.1% to 1.5% and most preferably from 0.1% to 0.8%.

The compositions of the present invention may further comprise a solvent or a mixture thereof. Solvents to be used herein include all those known to the those skilled in the art of hard-surfaces cleaner compositions. Suitable solvents for use herein include ethers and diethers having from 4 to 14 carbon atoms, preferably from 6 to 12 carbon atoms, and more preferably from 8 to 10 carbon atoms, glycols or alkoxylated glycols, alkoxylated aromatic alcohols, aromatic alcohols, aliphatic branched alcohols, alkoxylated aliphatic branched alcohols, alkoxylated linear C1–C5 alcohols, linear C1–C5 alcohols, C8–C14 alkyl and cycloalkyl hydrocarbons and halohydrocarbons, C6–C16 glycol ethers and mixtures thereof.

Suitable glycols to be used herein are according to the formula HO—CR1R2—OH wherein R1 and R2are independently H o r a C2–C10 saturated or unsaturated aliphatic hydrocarbon chain and/or cyclic. Suitable glycols to be used herein are dodecaneglycol and/or propanediol.

Suitable alkoxylated glycols to be used herein are according to the formula R(A)n—R1—OH wherein R is H, OH, a linear saturated or unsaturated alkyl of from 1 to 20 carbon atoms, preferably from 2 to 15 and more preferably from 2 to 10, wherein R1 is H or a linear saturated or unsaturated alkyl of from 1 to 20 carbon atoms, preferably from 2 to 15 and more preferably from 2 to 10, and A is an alkoxy group preferably ethoxy, methoxy, and/or propoxy and n is from 1 to 5, preferably 1 to 2. Suitable alkoxylated glycols to be used herein are methoxy octadecanol and/or ethoxyethoxyethanol.

Suitable alkoxylated aromatic alcohols to be used herein are according to the formula R $(A)_n$—OH wherein R is an alkyl substituted or non-alkyl substituted aryl group of from 1 to 20 carbon atoms, preferably from 2 to 15 and more preferably from 2 to 10, wherein A is an alkoxy group preferably butoxy, propoxy and/or ethoxy, and n is an integer of from 1 to 5, preferably 1 to 2. Suitable alkoxylated aromatic alcohols are benzoxyethanol and/or benzoxypropanol.

Suitable aromatic alcohols to be used herein are according to the formula R—OH wherein R is an alkyl substituted or non-alkyl substituted aryl group of from 1 to 20 carbon atoms, preferably from 1 to 15 and more preferably from 1 to 10. For example a suitable aromatic alcohol to be used herein is benzyl alcohol.

Suitable aliphatic branched alcohols to be used herein are according to the formula R—OH wherein R is a branched saturated or unsaturated alkyl group of from 1 to 20 carbon atoms, preferably from 2 to 15 and more preferably from 5 to 12. Particularly suitable aliphatic branched alcohols to be used herein include 2-ethylbutanol and/or 2-methylbutanol.

Suitable alkoxylated aliphatic branched alcohols to be used herein are according to the formula R $(A)_n$—OH wherein R is a branched saturated or unsaturated alkyl group of from 1 to 20 carbon atoms, preferably from 2 to 15 and more preferably from 5 to 12, wherein A is an alkoxy group preferably butoxy, propoxy and/or ethoxy, and n is an integer of from 1 to 5, preferably 1 to 2. Suitable alkoxylated aliphatic branched alcohols include 1-methylpropoxyethanol and/or 2-methylbutoxyethanol.

Suitable alkoxylated linear C1–C5 alcohols to be used herein are according to the formula R $(A)_n$—OH wherein R is a linear saturated or unsaturated alkyl group of from 1 to 5 carbon atoms, preferably from 2 to 4, wherein A is an alkoxy group preferably butoxy, propoxy and/or ethoxy, and n is an integer of from 1 to 5, preferably 1 to 2. Suitable alkoxylated aliphatic linear C1–C5 alcohols are butoxy propoxy propanol (n-BPP), butoxyethanol, butoxypropanol, ethoxyethanol or mixtures thereof. Butoxy propoxy propanol is commercially available under the trade name n-BPP® from Dow chemical.

Suitable linear C1–C5 alcohols to be used herein are according to the formula R—OH wherein R is a linear saturated or unsaturated alkyl group of from 1 to 5 carbon atoms, preferably from 2 to 4. Suitable linear C1–C5 alcohols are methanol, ethanol, propanol or mixtures thereof.

Other suitable solvents include butyl diglycol ether (BDGE), butyltriglycol ether, ter amilic alcohol and the like. Particularly preferred solvents to be used herein are butoxy propoxy propanol, butyl diglycol ether, benzyl alcohol, butoxypropanol, ethanol, methanol, isopropanol and mixtures thereof.

Typically, the compositions of the present invention comprise up to 20% by weight of the total composition of a solvent or mixtures thereof, preferably from 0.5% to 10% by weight and more preferably from 1% to 8%.

The liquid compositions herein may also comprise a bleaching component. Any bleach known to those skilled in the art may be suitable to be used herein including any peroxygen bleach as well as a clorine releasing component.

Suitable peroxygen bleaches for use herein include hydrogen peroxide or sources thereof. As used herein a source of hydrogen peroxide refers to any compound which produces active oxygen when said compound is is contact with water. Suitable water-soluble sources of hydrogen peroxide for use herein include percarbonates, performed percarbolic acids, persilicates, persulphates, perborates, organic and inorganic peroxides and/or hydroperoxides.

Suitable chlorine releasing component for use herein is an alkali metal hypochlorite. Advantageously, the composition of the invention are stable in presence of this bleaching component. Although alkali metal hypochlorites are preferred, other hypochlorite compounds may also be used herein and can be selected from calcium and magnesium hypochlorite. A preferred alkali metal hypochlorite for use herein is sodium hypochlorite.

The compositions of the present invention that comprise a peroxygen bleach may further comprise a bleach activator or mixtures thereof. By "bleach activator", it is meant herein a compound which reacts with peroxygen bleach like hydrogen peroxide to form a peracid. The peracid thus formed constitutes the activated bleach. Suitable bleach activators to be used herein include those belonging to the class of esters, amides, imides, or anhydrides. Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactams selected from the group consisting of substituted or unsudstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is enviromental-friendly as it eventually degrades into citric acid and alcohol. Furthermore, acetyl triethyl citrate has a good hydrolytical stability in the product upon storage and it is an efficient bleach activator. Finally, it provides good building capacity to the composition.

Packaging form of the Compositions:

The compositions herein may be packaged in a variety of suitable detergent packaging known to those skilled in the art. The liquid compositions are preferably packaged in conventional detergent plastic bottles.

In one embodiment the compositions herein may be packaged in manually operated spray dispensing containers, which are usually made of synthetic organic polymeric plastic materials. Accordingly, the present invention also encompasses liquid cleaning compositions of the invention packaged is a spray dispenser, preferably in a trigger spray dispenser or pump spray dispenser.

Indeed, said spray-type dispensers allow to uniformly apply to a relatively large area of a hand-surface to be cleaned the liquid cleaning compositions suitable for use according to the present invention. Such spray-type dispensers are particularly suitable to clean vertical surfaces.

Suitable spray-type dispensers to be used according to the present invention include manually operated foam trigger-type dispensers sold for example by Specialty Packaging Products, Inc. or Continental Sprayers, Inc. These types of dispensers are disclosed, for instance, in U.S. Pat. No.

4,701,311 to Dunnining et al. and U.S. Pat. No. 4,646,973 and U.S. Pat. No. 4,538,745 both to Focarracci. Particularly preferred to be used herein are spray-type dispensers such as T 8500® commercially available from Continental Spray International or T 8100® commercially available from Canyon, Northern Ireland. In such a dispenser the liquid composition is divided in fine liquid droplets resulting in a spray that is directed onto the surface to be treated. Indeed, in such a spray-type dispenser the composition contained in the body of said dispenser is directed through the spray-type dispenser head via energy communicated to a pumping mechanism by the user as said user activates said pumping mechanism. More particularly, in said spray-type dispenser head the composition is forced against an obstacle, e.g. a grid or a cone or the like, thereby providing shocks to help atomise the liquid composition, i.e. to help the formation of liquid droplets.

The process of Cleaning a Hard-surface:

The present invention also encompasses a process of cleaning a hard-surface wherein a liquid composition comprising a comprise a dicapped polyalkoxylene glycol according to the formula:

$$R_1—O—(CH_2—CHR_2O)_n—R_3$$

wherein the substituents $R_1$ and $R_3$ each independently are substituted or unsubstituted, saturated or unsaturated, linear or branched hydrocarbon chains having from 1 to 30 carbon atoms, or amino bearing linear or branched, substituted or unsubstituted hydrocarbon chains having from 1 to 30 carbon atoms, $R_2$ is hydrogen or a linear or branched hydrocarbon chain having from 1 to 30 carbon atoms, and wherein n is an integer greater than 0, with the proviso that when both the substituents $R_1$ and $R_3$ independently are substituted or unsubstituted, saturated or unsaturated, linear or branched hydrocarbon chains having from 1 to 30 carbon atoms and $R_2$ is hydrogen or a linear or branched hydrocarbon chain having from 1 to 30 carbon atoms, then n is greater than 20, is contacted with said surface.

The features of the compositions used in the process of cleaning a hard-surface (optional ingredients, levels and so on) are as defined herein before.

By "hard-surfaces" it is meant herein any kind of surfaces typically found in houses like kitchens, bathrooms, car interiors or exteriors, e.g., floors, walls, tiles, windows, sinks, showers, shower plastified curtains, wash basins, WCs, dishes, fixtures and fittings and the like made of different materials like ceramic, vinyl, no-wax vinyl, linoleum, melamine, glass, any plastics, plastified wood, metal or any painted or varnished or sealed surface and the like. Hard-surfaces also include household appliances including, but not limited to, refrigerators, freezers, washing machines, automatic dryers, ovens, microwave ovens, dishwashers and so on.

The liquid compositions of the present invention may be contacted with the surface to be cleaned in its neat form or in its diluted form.

By "diluted form" it is meant herein that said liquid composition is diluted by the user typically with water. The composition is diluted prior use to a typical dilution level of 10 to 200 times its weight of water, preferably of 10 to 100. Usual recommended dilution level is a 1.2% dilution of the composition in water.

In the preferred process of cleaning hard-surfaces according to the present invention where said composition is used in diluted form, there is no need to rinse the surface after application of the composition in order to obtain excellent first and next-time cleaning performance as well as good surface appearance.

The present invention will be further illustrated by the following examples.

EXAMPLES

The following compositions were made by mixing the listed ingredients in the listed proportions. All proportions are % by weight of the total composition.

These compositions were used neat and diluted to clean hard-surfaces like floors. Excellent next-time cleaning performance while delivering also good first time cleaning and good surface appearance to the surfaces cleaned.

Compositions (weight %):

| | A | B | C | D | E | F |
|---|---|---|---|---|---|---|
| Nonionic surfactants | | | | | | |
| C 9–11 EO5 | — | — | 2.5 | 2.4 | 1.9 | 2.5 |
| C12,14 EO5 | — | — | 2.5 | 3.6 | 2.9 | 2.5 |
| C7–9 EO6 | 3.2 | 8 | — | — | — | — |
| Dobanol ® 23-3 | 1.3 | 3.2 | — | — | — | — |
| AO21 | 1.9 | 4.8 | 2.0 | 1.0 | 0.8 | 4.0 |
| Anionic surfactants | | | | | | |
| NaPS | — | 3.0 | — | — | — | — |
| NaLAS | 0.9 | — | 0.8 | — | — | — |
| NaCS | 1.2 | 3.0 | 1.5 | 1.5 | 2.6 | — |
| $C_8$-AS | 0.8 | 2.0 | — | — | — | — |
| Isalchem ® AS | — | — | — | 0.6 | 0.6 | — |
| Buffer | | | | | | |
| $Na_2CO_3$ | 1.0 | 2.0 | 0.2 | 0.6 | 0.13 | 0.6 |
| Citrate | — | — | 0.75 | 0.5 | 0.56 | 0.5 |
| Caustic | — | — | 0.5 | 0.3 | 0.33 | 0.3 |
| Suds control | | | | | | |
| Fatty Acid | 0.4 | 0.8 | 0.4 | 0.6 | 0.3 | 0.5 |
| Isofol 12 ® | 0.3 | — | 0.3 | 0.3 | 0.3 | — |
| Polymers | | | | | | |
| PEG DME-2000 ® | 0.5 | 0.75 | 0.5 | 0.4 | — | 0.25 |
| Jeffamine ® ED-2001 | — | — | — | — | 0.5 | — |
| Polyglycol AM ® 1100 | — | — | — | — | — | — |
| Water and minors | | | up to 100% | | | |
| pH | 10.75 | 10.75 | 9.5 | 9.5 | 7.4 | 9.5 |

| | G | H | I | J | K |
|---|---|---|---|---|---|
| Nonionic surfactants | | | | | |
| C 9–11 EO5 | — | 2.5 | — | 2.5 | 0.030 |
| C12,14 EO5 | 2.5 | 2.5 | — | 2.5 | 0.030 |
| C7–9 EO6 | — | — | 3.2 | — | — |
| Dobanol ® 23-3 | | — | 1.3 | — | — |
| AO21 | | 2.0 | 1.9 | 4.0 | 0.024 |
| Anionic surfactants | | | | | |
| NaPS | — | — | — | — | — |
| NaLAS | 4.0 | 0.8 | 0.9 | — | 0.009 |
| NaCS | 2.3 | 1.5 | 1.2 | — | 0.018 |
| $C_8$-AS | — | — | 0.8 | — | — |
| Isalchem ® AS | — | — | — | — | — |
| Buffer | | | | | |
| $Na_2CO_3$ | 1.0 | 0.1 | 1.0 | 0.6 | 0.002 |
| Citrate | — | 0.6 | — | 0.5 | 0.009 |
| Caustic | — | 0.3 | — | 0.3 | 0.006 |
| Suds control | | | | | |
| Fatty Acid | 0.4 | 0.5 | 0.4 | 0.5 | 0.005 |
| Isofol 12 ® | 0.3 | 0.3 | 0.3 | — | 0.004 |
| Polymers | | | | | |
| PEG DME-2000 ® | — | 0.35 | 0.5 | 0.25 | 0.006 |
| Jeffamine ® ED-2001 | — | — | — | — | — |

-continued

| | | | | | |
|---|---|---|---|---|---|
| Polyglycol AM ® 1100 | 0.5 | — | — | — | — |
| Polyquat 11 ® | — | — | 0.5 | | 0.006 |
| PVP K60 ® | — | — | — | 0.6 | — |
| Water and minors | | | up to 100% | | |
| pH | 10.5 | 7.5 | 10.75 | 9.5 | 8.5 |

PEG DME-2000® is dimethyl polyethylene glycol (MW 2000) commercially available from Hoescht.

Polyglycol AM® 1100 is a dicapped polyethylene glycol (MW~1100) commercially available from Hoechst.

Jeffamine® ED-2001 is a dicapped polyethylene glycol commercially available from Huntsman.

Isofol 12® is 2-butyl octanol

Dobanol® 23-3 is a C12–C13 EO 3 nonionic surfactant commercially available from SHELL.

C8-AS is octyl sulphate available from Albright and Wilson, under the tradename Empimin® LV 33.

AO21 is a C12–14 EO21 alcohol ethoxylate.

Isalchem® AS is a branched alcohol alkyl sulphate commercially available from Enichem.

PVP K60® is a vinylpyrrolidone homopolymer (average molecular weight of 160,000), commercially available from ISP Corporation, New York, N.Y. and Montreal, Canada.

Polyquat 11® is a quaternized copolymers of vinyl pyrrolidone and dimethyl aminoethylmethacrylate commercially available from BASF.

What is claimed is:

1. An aqueous liquid hard-surface cleaning composition having a pH of from about 7 to about 13, said composition comprising 0.1–2% by weight of a subs controlling agent and a dicapped polyalkoxylene glycol of the formula:

$$R_1—O—(CH_2—CHR_2O)_n—R_3,$$

wherein the substituents $R_1$ and $R_3$ each independently are substituted or unsubstituted, saturated or unsaturated, linear or branched hydrocarbon chains having from about 1 to about 30 carbon atoms, or amino bearing linear or branched, substituted or unsubstituted hydrocarbon chains having from about 1 to about 30 carbon atoms, $R_2$ is hydrogen or a linear or branched hydrocarbon chain having from about 1 to about 30 carbon atoms, and wherein n is an integer greater than 0, with the proviso that when both the substituents $R_1$ and $R_3$ independently are substituted or unsubstituted, saturated or unsaturated, linear or branched hydrocarbon chains having from about 1 to about 30 carbon atoms and $R_2$ is hydrogen or a linear or branched hydrocarbon chain having from about 1 to about 30 carbon atoms, then n is greater than 20.

2. The composition according to claim 1 wherein said composition comprises from about 0.001% to about 20% by weight of the total composition of a dicapped polyalkoxylene glycol or mixture thereof.

3. The composition according to claim 2 wherein said composition comprises from about 0.01% to about 5% by weight of the total composition of a dicapped polyalkoxylene glycol or mixture thereof.

4. A composition according to claim 1 wherein for said dicapped polyalkoxylene glycol according to the formula $R_1—O—(CH_2—CHR_2O)_n—R_3$, the substituents $R_1$ and $R_3$ each independently are substituted or unsubstituted, saturated or unsaturated, linear or branched alkyl groups, alkenyl groups or aryl groups having from about 1 to about 30 carbon atoms, or amino bearing linear or branched, substituted or unsubstituted alkyl groups, alkenyl groups or aryl groups having from about 1 to about 30 carbon atoms, $R_2$ is hydrogen, or a linear or branched alkyl group, alkenyl group or aryl group having from about 1 to about 30 carbon atoms, and n is an integer above 20.

5. The composition according to claim 1 wherein said dicapped polyalkoxylene glycol is O,O'-bis(2-aminopropyl) polyethylene glycol (MW 2000), O,O'-bis(2-aminopropyl) polyethylene glycol (MW 400), O,O'-dimethyl polyethylene glycol (MW 2000), dimethyl polyethylene glycol (MW 2000), or a mixture thereof.

6. The composition according to claim 1 wherein said composition is an aqueous liquid composition having a pH of from about 9 to about 11.

7. A composition according claim 1 wherein said composition further comprises a surfactant selected from the group consisting of nonionic surfactants, anionic surfactants, zwitterionic surfactants, amphoteric surfactants, cationic surfactants and mixtures thereof, at a level of from 0.1% to 50% of the total composition.

8. The composition according to claim 7 wherein said surfactant is present at a level of from about 0.1% to about 20% of the total composition.

9. The composition according to claim 1 wherein said composition further comprises a vinylpyrrolidone homopolymer or copolymer or a mixture thereof at a level up to about 20% by weight of the total composition.

10. The composition according to claim 9 wherein said composition comprises said vinylpyrrolidone homopolymer or copolymer or a mixture thereof at a level from about 0.01% to about 10% by weight of the total composition.

11. A composition according to claim 9 wherein said vinylpyrrolidone copolymer is a quaternized or unquaternized vinylpyrrolidone/dialkylaminoalkyl acrylate or methacrylate according to the following formula:

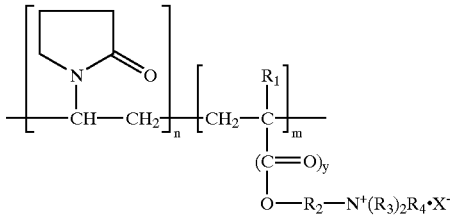

in which n is between about 20 and about 99 mol % and m is between about 1 and about 80 mol %; $R_1$ represents H or $CH_3$; y denotes 0 or 1; $R_2$ is $—CH_2—CHOH—CH_2—$ or $C_xH_{2x}$, in which x=2 to 18; $R_3$ represents a lower alkyl group of from about 1 to about 4 carbon atoms, or

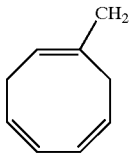

$R_4$ denotes a lower alkyl group of from about 1 to about 4 carbon atoms; $X^-$ is chosen from the group consisting of Cl, Br, I, $1/2SO_4$, $HSO_4$ and $CH_3SO_3$.

12. The composition according to claim 1 wherein said composition further comprises at least an optional ingredient selected from the group consisting of other polymers, perfumes, chelating agents, builders, solvents, buffers, bactericides, hydrotropes, colorants, stabilizers, radical scavengers, bleaches, bleach activators, enzymes, soil suspenders, dye transfer agents, brighteners, sud control agents, anti dusting agents, dispersants, dye transfer inhibitors, pigments, dyes and mixtures thereof.

13. A process of cleaning a hard-surface wherein a liquid composition according to claim 1 is contacted with said surface.

14. A process of cleaning a hard-surface according to claim 13 wherein said composition is contacted with said surface after having been diluted with water.

15. A process according to claim 14 wherein said surface is not rinsed after said composition has been contacted therewith.

* * * * *